US008465100B2

(12) United States Patent
Kim

(10) Patent No.: US 8,465,100 B2
(45) Date of Patent: Jun. 18, 2013

(54) PORTABLE FOOTREST

(76) Inventor: Jung Eung Kim, Los Angeles, CA (US)

( * ) Notice: Subject to any disclaimer, the term of this patent is extended or adjusted under 35 U.S.C. 154(b) by 106 days.

(21) Appl. No.: 13/005,513

(22) Filed: Jan. 12, 2011

(65) Prior Publication Data

US 2011/0181091 A1 Jul. 28, 2011

(30) Foreign Application Priority Data

Jan. 28, 2010 (KR) ..... 20-2010-0000961 U

(51) Int. Cl.
*A47C 16/02* (2006.01)

(52) U.S. Cl.
USPC ..... 297/423.41

(58) Field of Classification Search
USPC ..... 297/423.41, 423.39; 108/115, 90, 108/132, 129; 182/153, 186.5, 223
See application file for complete search history.

(56) References Cited

U.S. PATENT DOCUMENTS

| | | | | |
|---|---|---|---|---|
| 402,175 | A * | 4/1889 | Maurer | 182/183.1 |
| 1,063,642 | A * | 6/1913 | Birdsall | 108/36 |
| 1,905,282 | A * | 4/1933 | Hatfield | 108/92 |
| 2,572,333 | A | 10/1951 | Myer Greitzer | |
| 2,642,325 | A | 6/1953 | Hinsken et al. | |
| 2,696,246 | A * | 12/1954 | Putnam | 108/93 |
| 3,271,075 | A * | 9/1966 | Good | 297/423.41 |
| D206,379 | S | 12/1966 | Good et al. | |
| 3,976,163 | A | 8/1976 | Watkinson | |
| 4,378,828 | A | 4/1983 | Shiminski | |
| 4,383,488 | A | 5/1983 | Macho et al. | |
| 4,389,946 | A | 6/1983 | Hwang | |
| D273,252 | S | 4/1984 | Markson | |
| 4,462,636 | A | 7/1984 | Markson | |
| 4,533,179 | A | 8/1985 | Nichols et al. | |
| 4,950,033 | A | 8/1990 | Anderson | |
| 4,989,916 | A | 2/1991 | Powell | |
| 4,991,908 | A | 2/1991 | Krechel | |
| 5,244,255 | A | 9/1993 | Mill | |
| 5,316,374 | A | 5/1994 | Fidler | |
| 5,383,411 | A | 1/1995 | Tomaka et al. | |
| 5,984,047 | A | 11/1999 | Rogers | |
| 6,289,824 | B1 | 9/2001 | Parker | |

(Continued)

OTHER PUBLICATIONS

Office Action for U.S. Appl. No. 12/290,383, filed Oct. 30, 2008; Inventor: Jung Eung Kim. All cited references are accessible via USPTO and www.wipo.in websites; date of the USPTO Office Action: Jun. 30, 2011.

(Continued)

*Primary Examiner* — Milton Nelson, Jr.
(74) *Attorney, Agent, or Firm* — Peter Ganjian; Patent Law Agency, LLC

(57) ABSTRACT

The present invention relates to a portable footrest including a top plate, a leg which supports the top plate and which is foldable, a support for maintaining the leg at an upright state, and a slider which has a square C-shaped sliding portion formed at a portion of both sides thereof and ended at an end thereof, and which has protrusions formed at a lower surface thereof. The slider is arranged at both sides of the top plate, and the sliding portion of the slider moves along an edge of the top plate.

3 Claims, 5 Drawing Sheets

U.S. PATENT DOCUMENTS

| | | | | |
|---|---|---|---|---|
| 6,454,357 | B1 | 9/2002 | Foulger | |
| 6,779,466 | B2 | 8/2004 | Shabram, Jr. | |
| 6,966,404 | B2 | 11/2005 | Meeker | |
| 7,007,771 | B2 * | 3/2006 | Rawlings et al. | 182/33 |
| 7,055,442 | B2 | 6/2006 | Podd et al. | |
| 7,066,547 | B1 | 6/2006 | Russell et al. | |
| 7,278,515 | B2 | 10/2007 | Moser et al. | |
| 7,905,184 | B2 | 3/2011 | Eveleth | |
| 2003/0102413 | A1 | 6/2003 | Svabek et al. | |
| 2004/0182288 | A1 | 9/2004 | Goldberg et al. | |
| 2005/0241552 | A1 | 11/2005 | Neunzert | |
| 2010/0186638 | A1 * | 7/2010 | Roy et al. | 108/25 |
| 2010/0187041 | A1 | 7/2010 | Crouch | |

OTHER PUBLICATIONS

European Patent Application No. 11161465.7; European Search Report, includes IDS of cited references; All cited references are accessible via USPTO and www.wipo.int website; Date of the EPO Office Action: Aug. 30, 2011.

WO 2007/114774; Edvardssons Traevaru ; Oct. 11, 2007; Submitted. Also Available via www.wipo.int.

WO 95/30356; Exess Technolgie; Leday Michjel; Nov. 16, 1995; Submitted. Also Available via www.wipo.int.

* cited by examiner

PORTABLE FOOTREST

CROSS-REFERENCE TO RELATED APPLICATIONS

This Application is a CONTINUATION application claiming the benefit of priority of the co-pending Republic of Korea Patent Application No. 20-2010-0000961 with a filing date of 28 Jan. 2010, the entire disclosure of which is expressly incorporated by reference in its entirety herein.

BACKGROUND OF THE INVENTION

1. Field of the Invention

The present invention relates to a portable footrest, and more particularly, to a portable footrest with an adjustable width.

2. Description of Related Art

Referring to FIG. 1, U.S. Design Pat. No. 273,252 discloses a footrest in which a top plate 10 has both sides on which legs 14 are attached via respective hinges 12. The legs 14 facing each other are foldable inwardly, and have respective stopper protrusions 16 at inner surfaces thereof so as to catch the other end of a support 18 of which one end is fixed at a lower surface of the top plate 10.

The thus-configured footrest has drawbacks in that the top plate 10 has a fixed width which is deficient in providing proper or comfortable support for a user who has long legs or wide thighs or for a user who needs comfortable support while relaxing.

Moreover, the above-described conventional footrest employs hinges 12, which increases costs.

BRIEF SUMMARY OF THE INVENTION

The present invention overcomes the foregoing problems, and it is an object of the present invention to provide a portable footrest of which top plate has an adjustable width.

To accomplish the object of the present invention, there is provided a portable footrest according to an embodiment of the present invention, comprising a top plate; a leg which supports the top plate and which is foldable; a support for maintaining the leg at an upright state; and a slider which has a square C-shaped sliding portion formed at a portion of both sides thereof and ended at an end thereof, and which has protrusions formed at a lower surface thereof, wherein said slider is arranged at both sides of the top plate, and wherein said sliding portion of the slider moves along an edge of the top plate. The protrusion of the slider stops when inserted into a plurality of holes formed at the top plate, and the slider stops sliding when the end thereof is brought into contact with a round portion of the leg.

The top plate has a plurality of ribs formed in a lengthwise direction thereof, and each of the ribs has both ends with respective holes. The innermost rib has a receiving portion. The leg has ribs to be inserted among the ribs of the top plate, and each of the ribs of the leg has an end with a hole corresponding to the hole of the rib of the top plate. A pin is inserted into the hole of the rib of the top plate and into the hole of the rib of the leg such that the leg is inwardly rotatable.

The portable footrest according to the present invention is advantageous in that sliders are arranged at both sides of the top plate to extend the width of the top plate, and the width of the portable footrest is same or smaller than that of the top plate to allow for convenience of carry.

While the invention is described in detail with specific reference to a single embodiment for a portable footrest, there is no intent to limit the invention to the embodiment described hereinafter. It will be apparent to those skilled in the art that various modifications may be made in the embodiment without departing from the spirit and scope of the appended claims of the invention.

DETAILED DESCRIPTION OF THE INVENTION

Figure 1:
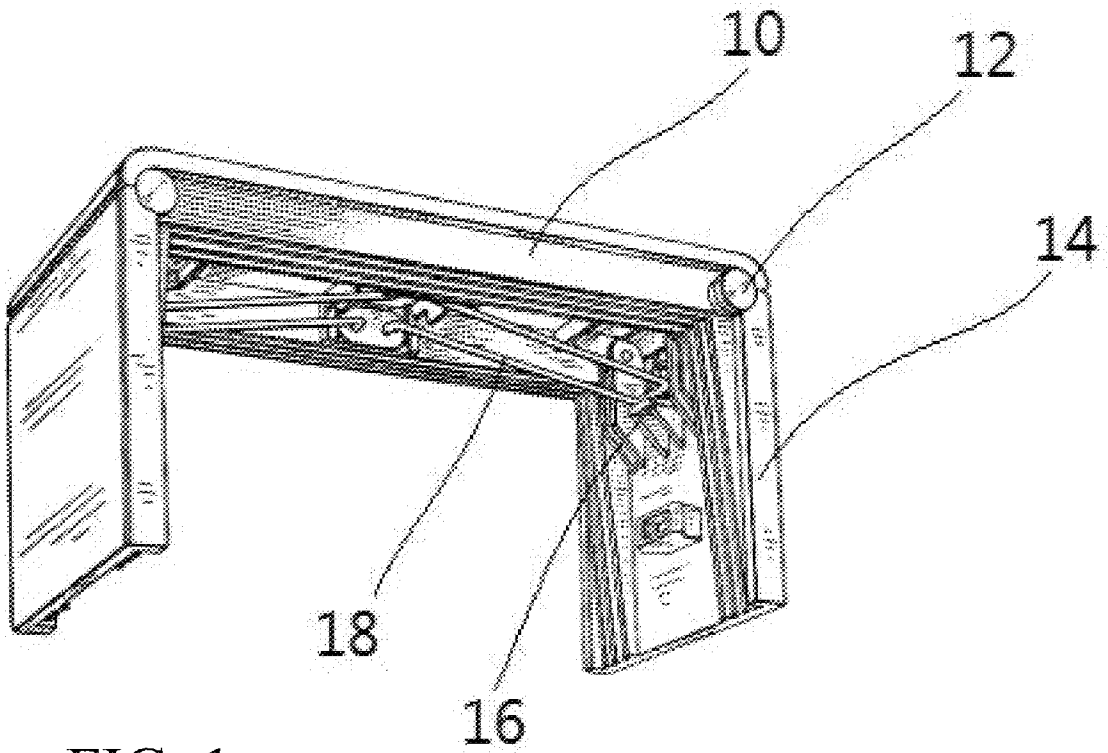
FIG. 1 is a perspective view of a conventional portable footrest.
Figure 2:
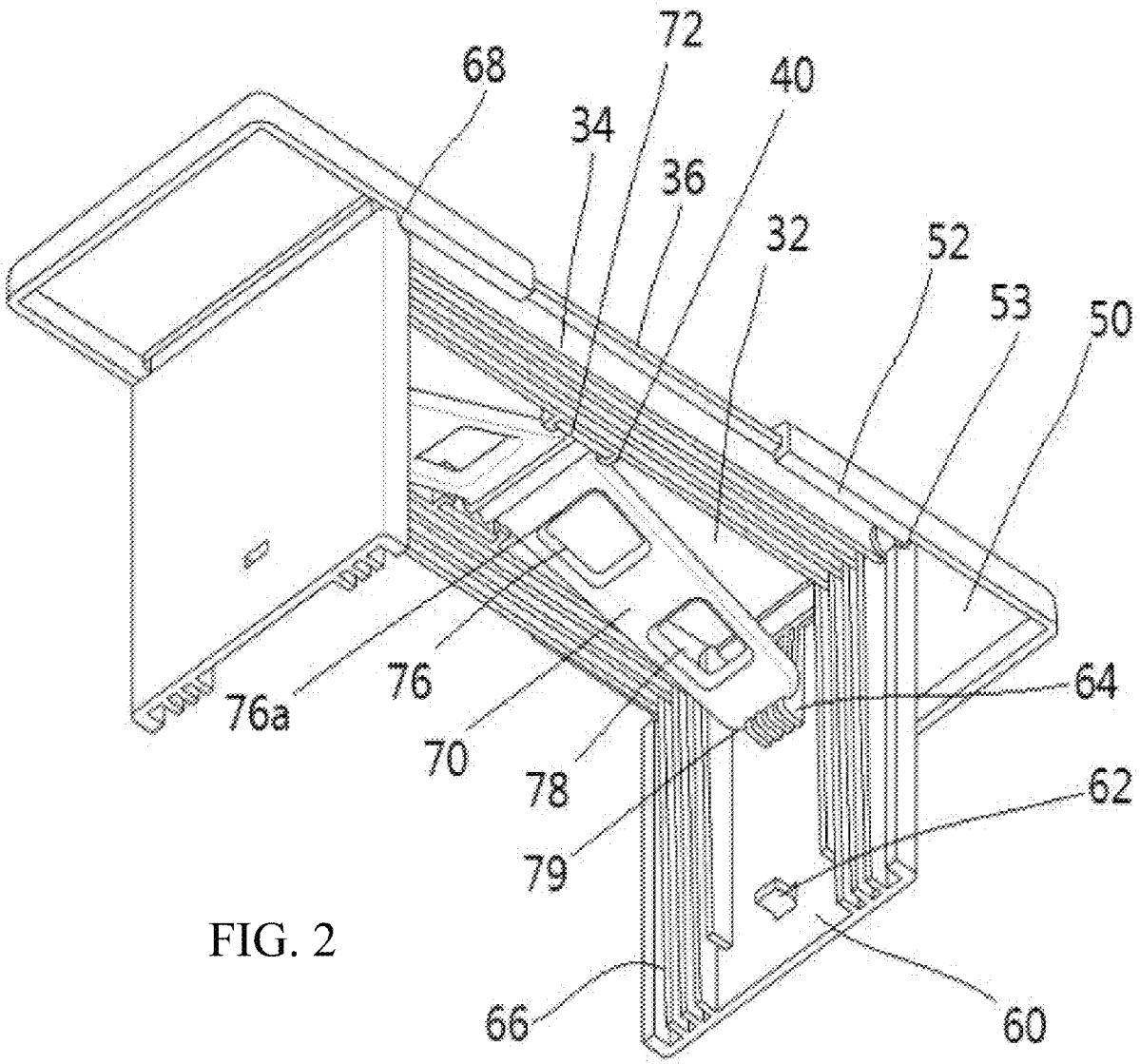
FIG. 2 is a perspective view of a portable footrest according to the present invention.

A footrest of the present invention comprises a top plate 32, a slider 50 which is arranged slidably on the top plate 32, a leg 60 which supports the top plate 32, and a support 70 for maintaining the leg 60 at an upright state.

The top plate 32 has a plurality of ribs 34 formed in a lengthwise direction thereof, and each of the ribs 34 has both ends with respective holes 35. The innermost rib has a receiving portion 40.

Figure 3:
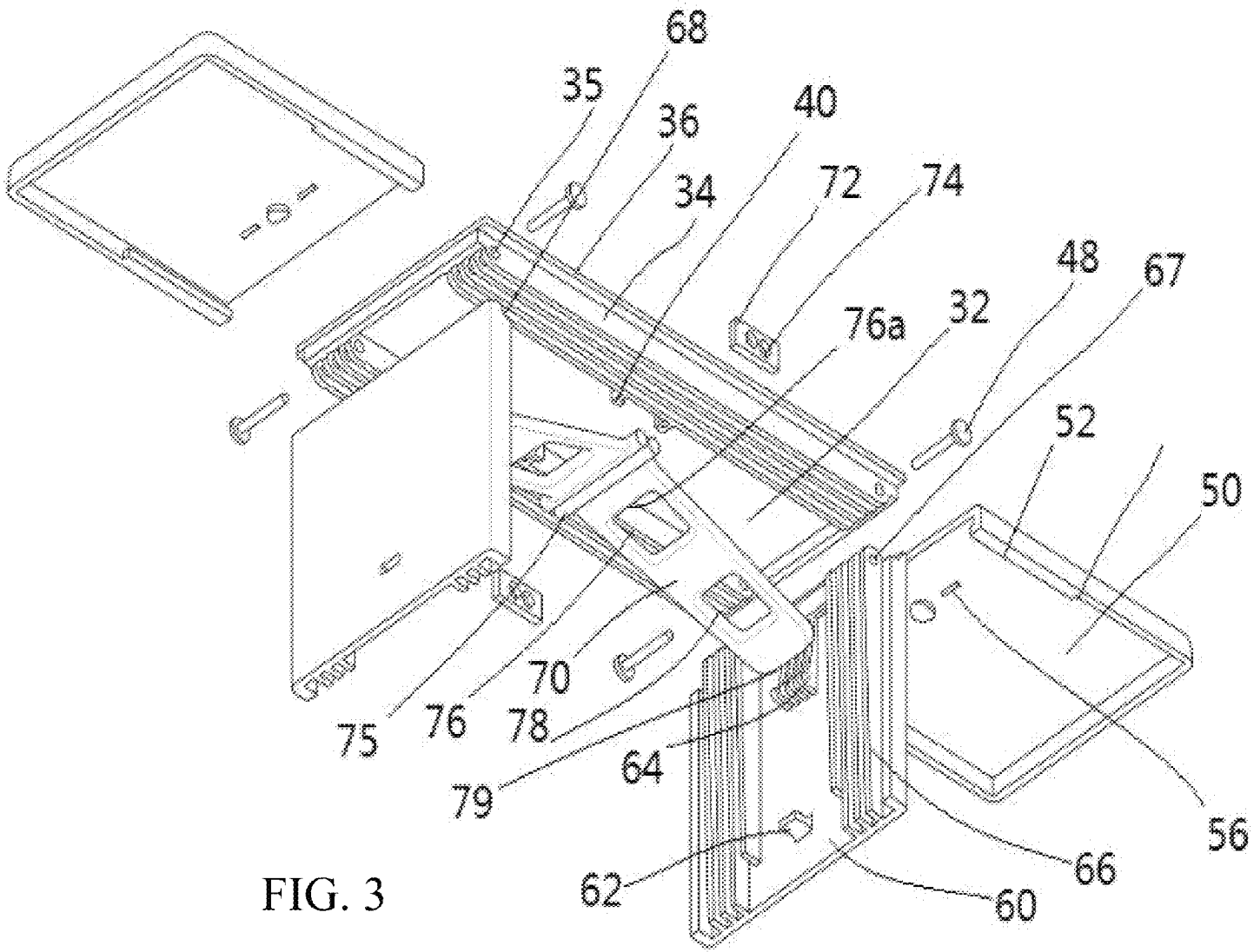
FIG. 3 is an exploded perspective view of a portable footrest according to the present invention.
Figure 4:
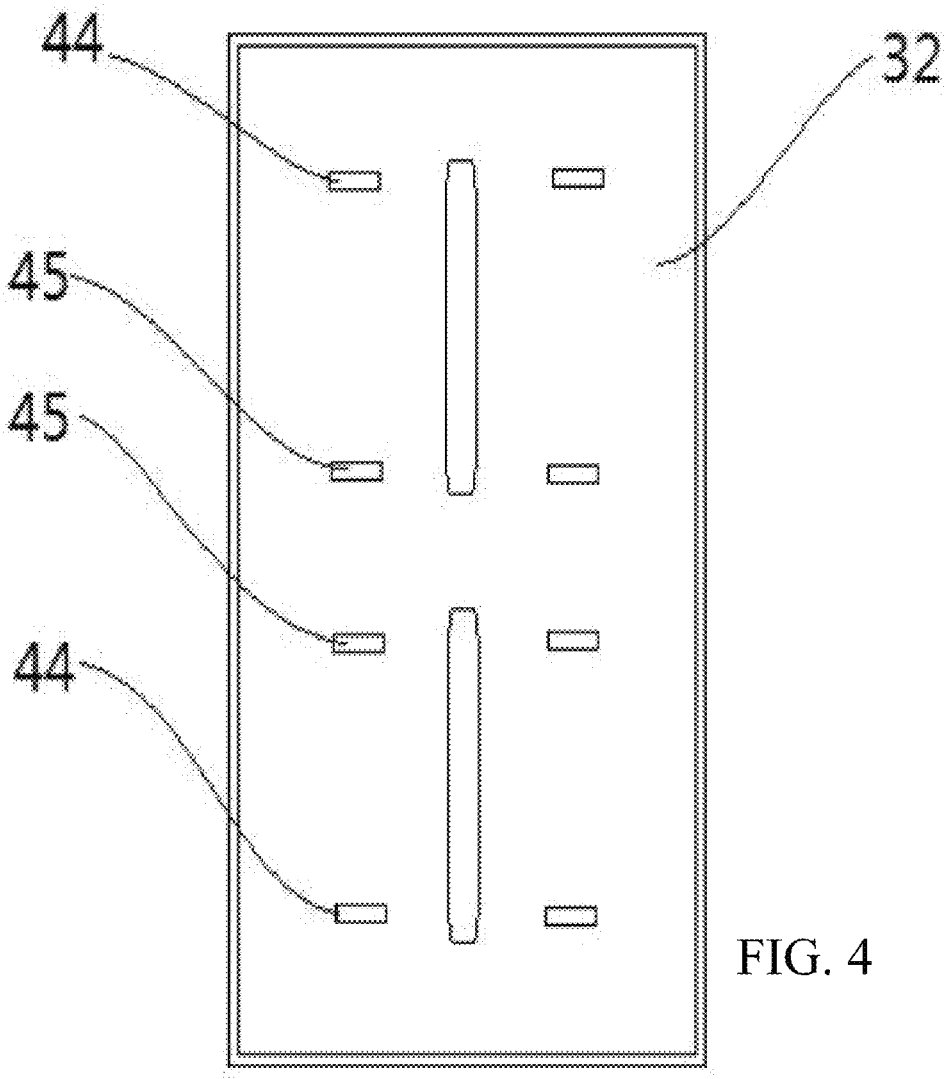
FIG. 4 is a plane view illustrating a top plate of a portable footrest according to the present invention.
Figure 5:
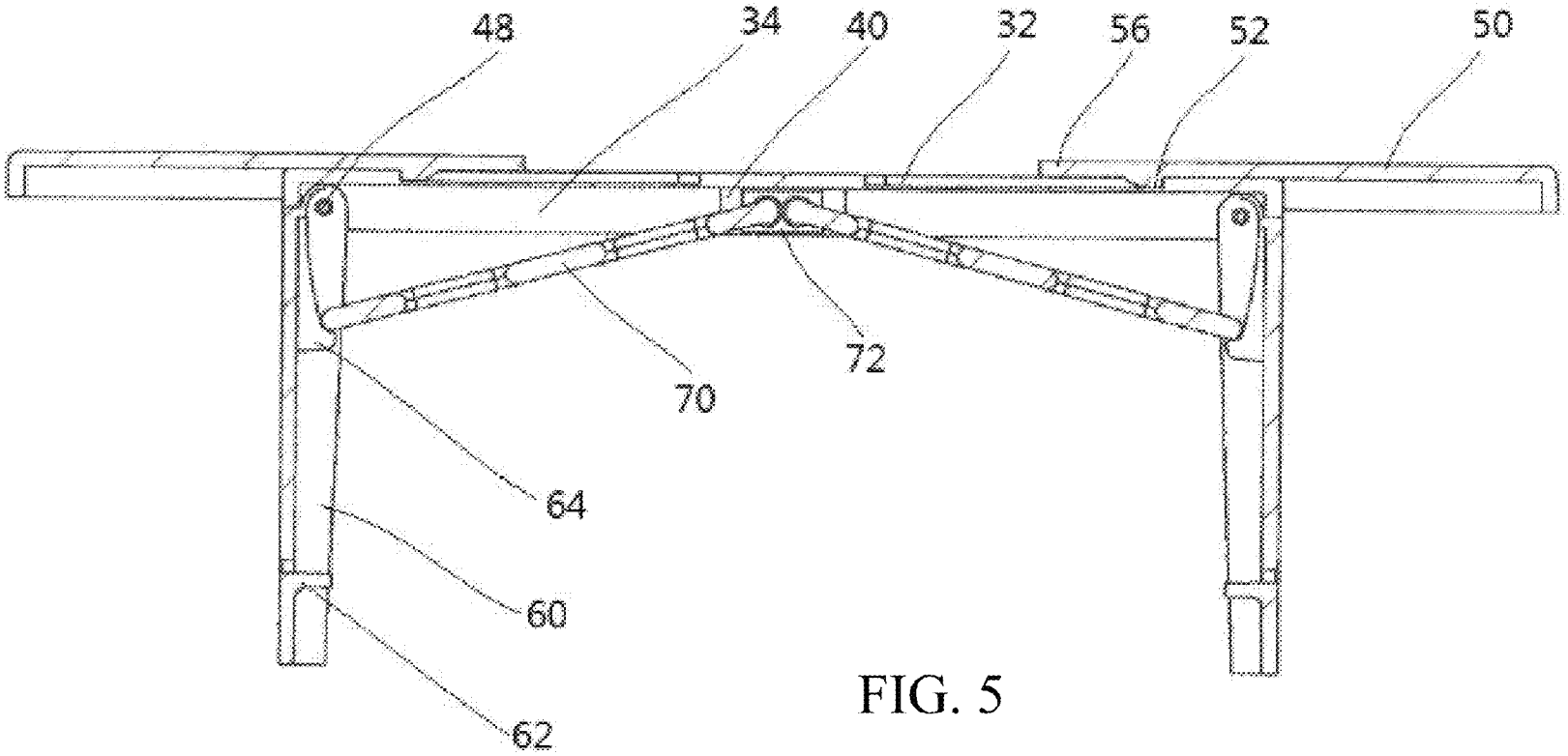
FIG. 5 is a cross sectional view of a portable footrest according to the present invention.

Referring to FIG. 3, the top plate 32 has pairs of closing holes 45 and extension holes 44 formed by regular spacing and arranged symmetrically with each other.

The slider 50 has a square C-shaped sliding portion 52 formed at a portion of both sides thereof and ended at an end 53 thereof. The slider 50 has two protrusions 56 formed at a lower surface thereof. The leg 60 has ribs 66 to be inserted among the ribs 34 of the top plate 32, and each of the ribs 66 of the leg 60 has an end with a hole 67 corresponding to the hole 35 of the rib 34 of the top plate 32. A pin 48 is inserted into the hole 35 of the rib 34 of the top plate 32 and into the hole 67 of the rib 66 of the leg 60 such that the leg 60 is inwardly rotatable. The leg 60 includes a stopper portion 64 protruded to catch the support 70, a hook 62 for hooking the leg 60 to the support 70 when the leg 60 is folded inwardly, and a round portion 68 which is brought into contact with the support 70 when the leg 60 stands upright so as to prevent the slider 50 from further sliding from the top plate 32.

The support 70 has a shaft 75 which is inserted into a hole 74 of a fixing portion 72 accommodated and fixed in the receiving portion 40, such that the support 70 is rotatable. The support 70 has a main body with a first space 76 and a second space 78, and has an end 79 which can be caught at the stopper portion 64 of the leg 60.

To use thus-configured footrest of the present invention, the leg 60 rotates about the pin 48 to allow the leg 60 to stand upright to form a right angle with respect to the top plate 32, and the support 70 rotates about the shaft 75 to allow the end 79 of the support 70 to get caught at the stopper portion 64 so as to maintain the leg 60 at the upright state. Subsequently, if needed, the slider 50 can be selectively drawn in the direction which permits the slider 50 to get far from the top plate 32, and then, the sliding portion 52 of the slider 50 slides along an edge 36 of the top plate 32. During sliding of the sliding portion 52, the protrusion 56 moves from the closing hole 45 to the extension hole 44 of the top plate 32, and the end 53 of the slider 50 is brought into contact with the round portion 68 of the leg 60 to prevent the slider 50 from further sliding.

Here, the slider 50 is pushed in the direction opposite to the sliding direction so as to be inserted into the closing hole 45 of the top plate 32, thus two sliders 50 nearly abut against each other. A user may extend sliders 50 to elongate the length of the top plate 32, and retract sliders 50 to their original locations to return to the original length of the top plate 32.

Although the present invention has described with an embodiment of the footstep having the top plate with two pairs of closing holes 45 and extension holes 44, it would be also understood that the top plate has more closing holes or extension holes than two pairs. Further, the closing holes 45 and the extension holes 44 might be formed alone, rather than in pairs.

When the footrest is not in use and hence stored, the protrusion 56 of the slider 50 is inserted into the closing hole 45, and the leg 60 is moved slightly in the direction to get off from the support 70. Then, the support 70 is detached from the leg 60, and the end 79 of the support 70 is brought into contact with the lower surface of the top plate 32. Subsequently, the leg 60 is folded inwardly. When the leg 60 is folded, the stopper portion 64 is located within the second space 78 of the support 70, and the hook 62 gets caught at an edge 76*a* of the first space 76, thus preventing the leg 60 from rotating even when the top pate 32 is lifted. The present invention employs the pin 48 in place of a hinge to allow the leg 60 to stand upright.

DESCRIPTION OF REFERENCE NUMERALS

32: top plate
34: rib
35: hole
40: receiving portion
44: extension hole
45: closing hole
48: pin
50: slider
52: sliding portion
53: end
56: protrusion
60: leg
66: rib
67: hole
62: hook
64: stopper portion
68: round portion
70: support
72: fixing portion
74: hole
75: shaft
76: first space
78: second space
79: end

What is claimed is:

1. A portable footrest comprising
a top plate;
a leg which supports the top plate and which is foldable;
a support for maintaining the leg at an upright state; and
a slider which has a square C-shaped sliding portion formed at a portion of both sides thereof that has an end, and which has protrusions formed at a lower surface thereof,
said protrusions of the slider are inserted into a plurality of holes formed at the top plate, and the end of the slider is brought into contact with a round portion of the leg to prevent the slider from further sliding;
wherein said slider is arranged at both sides of the top plate, and
wherein said sliding portion of the slider moves along an edge of the top plate.

2. A portable footrest comprising:
a top plate;
a leg which supports the top plate and which is foldable;
a support for maintaining the leg at an upright state; and
a slider which has a square C-shaped sliding portion formed at a portion of both sides thereof that has an end, and which has protrusions formed at a lower surface thereof,
wherein said slider is arranged at both sides of the top plate, and
wherein said sliding portion of the slider moves along an edge of the top plate;
said top plate has a plurality of ribs formed in a lengthwise direction thereof,
each of the ribs has both ends with respective holes,
an innermost rib has a receiving portion,
the leg has ribs to be inserted among the ribs of the top plate,
each of the ribs of the leg has an end with a hole corresponding to the hole of the rib of the top plate, and
a pin is inserted into the hole of the rib of the top plate and into the hole of the rib of the leg such that the leg is inwardly rotatable.

3. A portable footrest comprising:
a top plate;
a leg which supports the top plate and which is foldable;
a support for maintaining the leg at an upright state; and
a slider which has a square C-shaped sliding portion formed at a portion of both sides thereof that has an end, and which has protrusions formed at a lower surface thereof,
said protrusions of the slider are inserted into a plurality of holes formed at the top plate, and the end of the slider is brought into contact with a round portion of the leg to prevent the slider from further sliding;
wherein said slider is arranged at both sides of the top plate, and
wherein said sliding portion of the slider moves along an edge of the top plate
said top plate has a plurality of ribs formed in a lengthwise direction thereof,
each of the ribs has both ends with respective holes,
an innermost rib has a receiving portion,
the leg has ribs to be inserted among the ribs of the top plate,
each of the ribs of the leg has an end with a hole corresponding to the hole of the rib of the top plate, and
a pin is inserted into the hole of the rib of the top plate and into the hole of the rib of the leg such that the leg is inwardly rotatable.

* * * * *